US006196712B1

(12) United States Patent
Elm

(10) Patent No.: US 6,196,712 B1
(45) Date of Patent: Mar. 6, 2001

(54) BAR HAVING AN INTEGRAL COCKTAIL MIXER

(76) Inventor: Gunter von Elm, 2097 Cleo La., Deltona, FL (US) 32738

( * ) Notice: Subject to any disclaimer, the term of this patent is extended or adjusted under 35 U.S.C. 154(b) by 0 days.

(21) Appl. No.: 09/366,842

(22) Filed: Aug. 4, 1999

Related U.S. Application Data

(60) Provisional application No. 60/095,381, filed on Aug. 5, 1998.

(51) Int. Cl.[7] ..... B01F 9/10

(52) U.S. Cl. ..... 366/197; 366/204; 366/208; 366/218; 366/349

(58) Field of Search ..... 366/349, 197, 366/200, 204, 208, 209, 212, 213, 218, 219, 220, 232, 237, 214, 215, 216, 217

(56) References Cited

U.S. PATENT DOCUMENTS

| | | | | |
|---|---|---|---|---|
| 206,443 | * | 7/1878 | Harris | 366/216 |
| 1,580,168 | * | 4/1926 | Ruef | 366/213 |
| 2,056,014 | * | 9/1936 | Moore et al. | 366/209 |
| 2,374,430 | * | 4/1945 | Hexter | 366/214 |
| 2,503,742 | * | 4/1950 | Kantor | 366/218 |
| 2,597,223 | * | 5/1952 | Burgess | 366/218 |
| 2,986,772 | * | 6/1961 | Patton, Jr. et al. | 366/213 |
| 3,181,841 | * | 5/1965 | Boehm | 366/217 |
| 3,228,522 | * | 1/1966 | Strand | 366/219 |
| 3,609,921 | * | 10/1971 | Foster et al. | 366/219 |
| 4,010,934 | | 3/1977 | McCord . | |
| 4,479,719 | | 10/1984 | McCartney . | |
| 5,358,330 | | 10/1994 | Moll . | |
| 5,547,275 | | 8/1996 | Lillelund et al. . | |

FOREIGN PATENT DOCUMENTS

| | | | | |
|---|---|---|---|---|
| 296939 | * | 3/1932 | (IT) | 366/219 |

* cited by examiner

*Primary Examiner*—Tony G. Soohoo
(74) *Attorney, Agent, or Firm*—Kenneth L Tolar

(57) ABSTRACT

A combination bar and beverage mixing device includes a base panel with a vertical shelf support attached thereto. Extending from the shelf support are upper and lower horizontal shelves. A blender assembly is slidably mounted on a horizontal track that is disposed between the upper and lower shelves. As the blender assembly is slid along the track, a mixing container is automatically rotated to mix a beverage received therein.

15 Claims, 3 Drawing Sheets

BAR HAVING AN INTEGRAL COCKTAIL MIXER

The following specification is hereby entitled to the benefit of the filing date of Provisional Application Ser. No. 60/095,381 filed on Aug. 5, 1998.

BACKGROUND OF THE INVENTION

The present invention relates to a bar having an associated blender assembly that, when slid along a horizontal track, automatically rotates to mix a beverage therein.

DESCRIPTION OF THE PRIOR ART

Producing cocktails and similar beverages from two or more ingredients has long been an inconvenience. Typically, the ingredients are placed into a container and a lid is placed thereon. The container is then repeatedly oscillated to produce the beverage which is burdensome and tiresome. Electrical blenders are often used but such devices require a power source that is not always conveniently located relative to the beverage serving or preparation area. The present invention provides a manually operable blender assembly integrally associated with a beverage serving/storage device thereby combining the features and advantages of both.

The prior art includes a number of hand-powered mixing devices. For example, U.S. Pat. No. 4,010,934 issued to McCord relates to a mixer comprising a pitcher receiving a centrally located shaft having a T-handle at one end and an impeller at the other.

U.S. Pat. No. 4,479,719 issued to McCartney relates to a drink mixer comprising a container resting on a circular base and having a preformed circular cover. The cover and container are slammed against the base to mix a drink.

U.S. Pat. No. 5,358,330 issued to Moll relates to a manual ingredient blending device comprising two attached cylindrical containers between which are two relatively adjustable screens for controlling and varying the mixing and blending of ingredients.

U.S. Pat. No. 5,547,275 issued to Lillelund, et al relates to a shaker and blender comprising a cylindrical container having a blender insert therein.

Although various beverage mixers exist in the prior art, none are integrally associated or in combination with a bar. The present invention provides a blender assembly slidably mounted on a horizontal track that is attached to a bar. The blender assembly automatically mixes a beverage received therein as the blender assembly is horizontally slid in either direction along the track.

SUMMARY OF THE INVENTION

The present invention relates to a bar having an integral cocktail blender assembly. The bar comprises a vertical base panel with support legs depending from a lower edge thereof. A shelf support is attached to the front surface of the base panel. Horizontally extending from the shelf support are an upper shelf and a lower shelf for storing beverage containers such as liquor bottles. Disposed between the upper and lower shelves is an elongated track having a blender assembly slidably mounted thereon. The blender assembly includes a receptacle having a drive shaft integrally extending from a lower portion thereof. The drive shaft is received within a gear housing that is slidably mounted on the track. A gear is mounted on the shaft and engages the track. Removably received within the receptacle is a mixing container. A beverage in the mixing container can be blended by sliding the gear housing along the track causing the gear, the receptacle and the mixing container to simultaneously rotate. It is therefore an object of the present invention to provide a novel and convenient apparatus for mixing cocktails.

It is another object of the present invention to provide a bar having an integral cocktail mixer thereby combining the features and advantages of both.

It is yet another object of the present invention to provide a device that conveniently mixes a beverage by simply sliding a blender assembly along a horizontal track. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
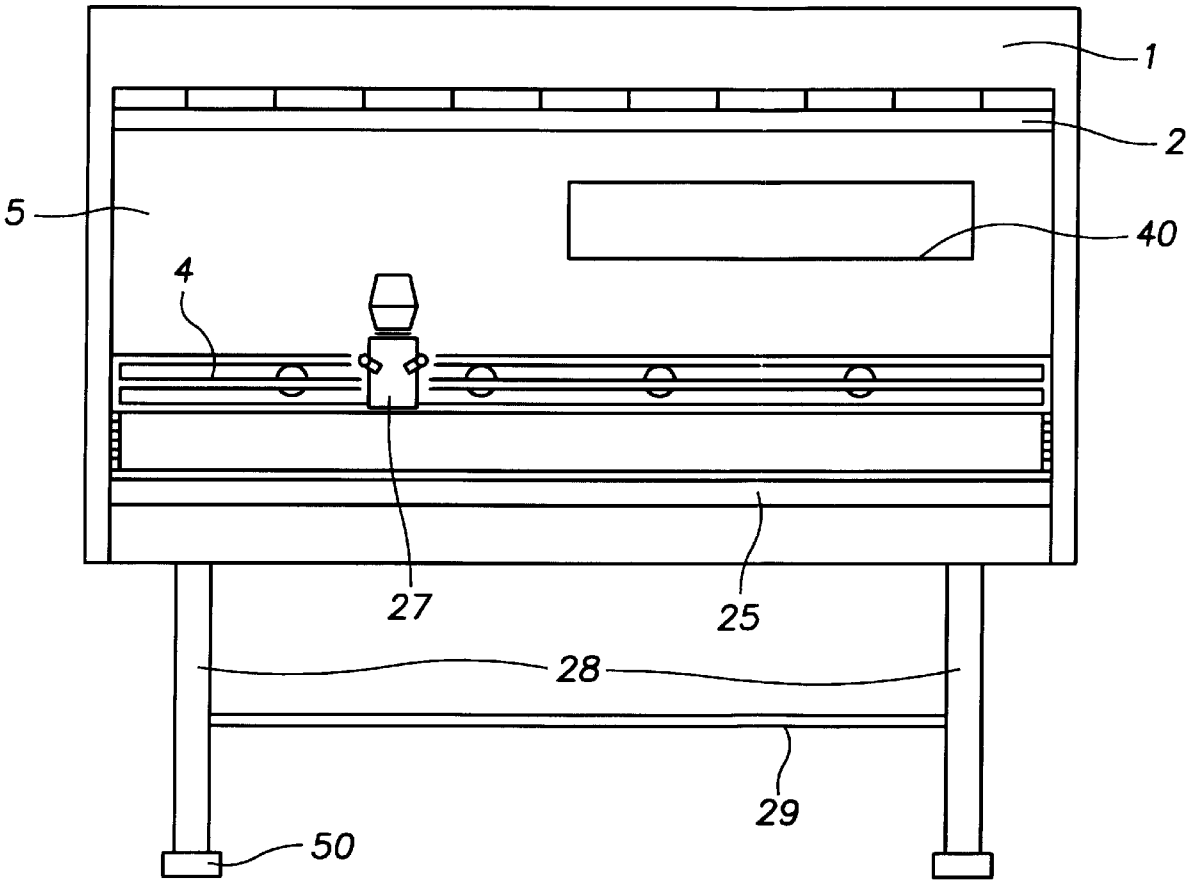
FIG. 1 is a front view of the present invention.
Figure 2:
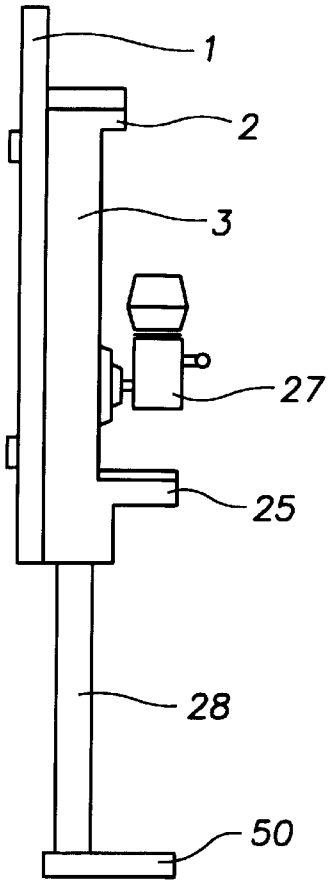
FIG. 2 is a side view of the present invention.
Figure 4:
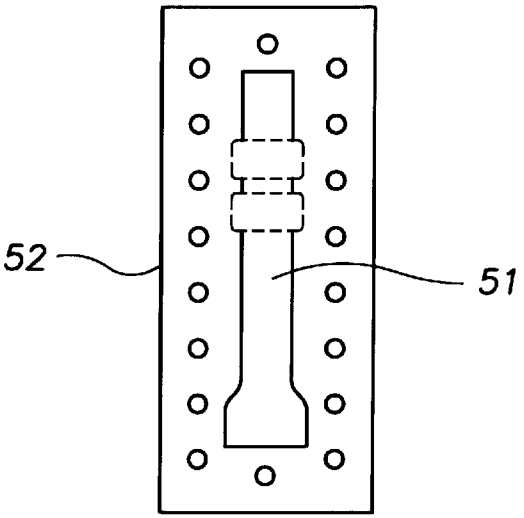
FIG. 4 is an enlarged view of a mounting plate.
Figure 3:
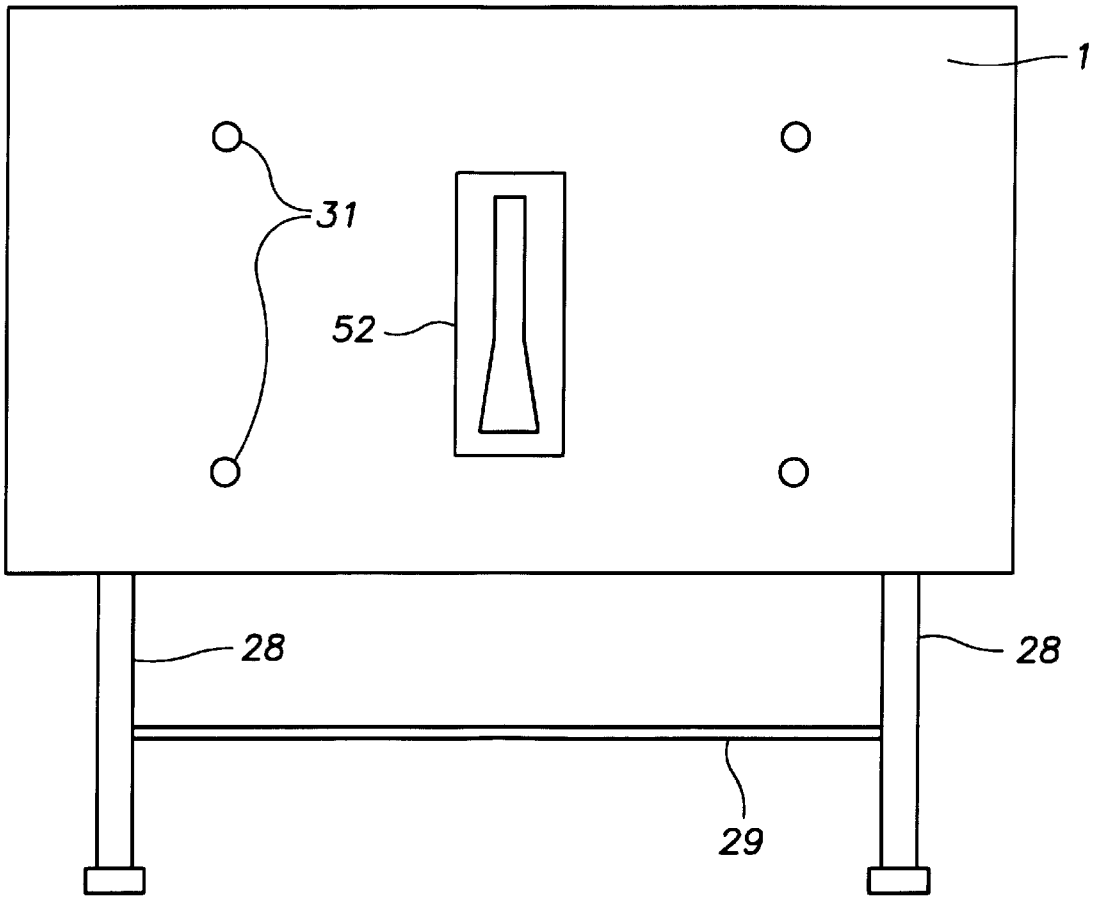
FIG. 3 is a rear view of the present invention.
Figure 6:
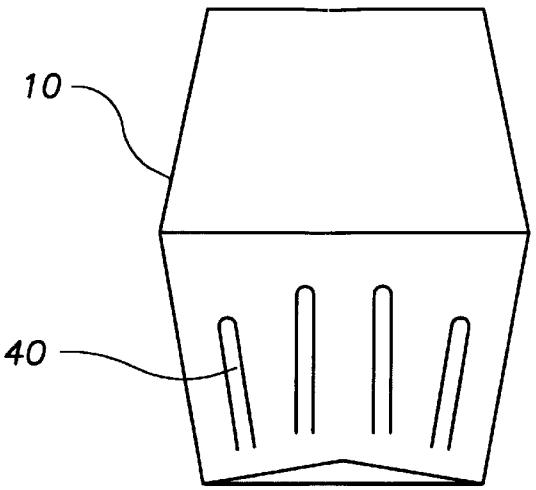
FIG. 6 is an enlarged view of the mixing container.

Referring now to FIGS. 1 through 6, the present invention relates to a combination bar and beverage mixing device. The device comprises a planar, substantially rectangular vertical base panel 1 having a lower edge, a front surface and a rear surface with a vertical shelf support 3 attached to the front surface. Two vertical support legs 28 depend from the lower edge that suspend the base panel a predetermined distance above a supporting surface. Attached to the bottom end of each support leg is a horizontally extending foot 50. The legs are stabilized by an interposed cross member 29. An upper shelf 2 and a lower shelf 25 horizontally extend from the shelf support. A track 4 is attached to the shelf support between the upper and lower shelves with a plurality of rods 17. The track includes a blender assembly 27 mounted thereon. The blender assembly will be described in more detail below. Between the track and upper shelf is a recessed, illuminable storage compartment 40.

A mounting plate 52 is attached to the rear surface of the base panel for securing the device to a vertical support such as a wall. The mounting plate contains an elongated slot 51 dimensioned to receive a fastener means such as a bolt imbedded within the wall. Accordingly, the assembly is substantially supported by the legs while the mounting plate and wall mounted bolts retain the device in an upright position. A plurality of spacers 31 are disposed on the rear surface of the base panel to maintain a predetermined minimum distance between the base panel and the wall.

Figure 5:
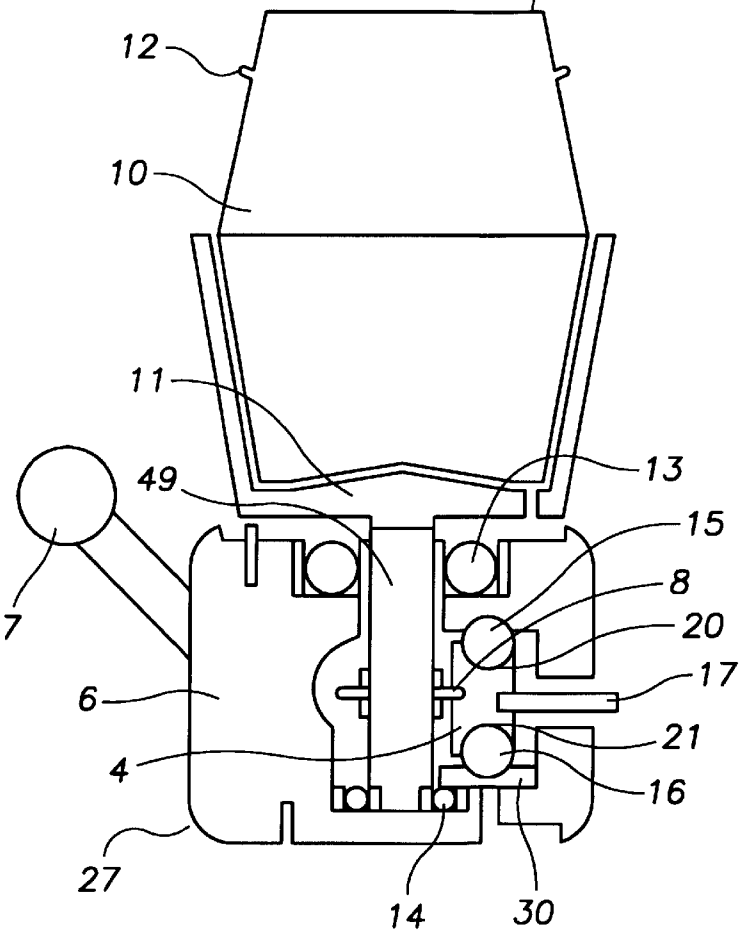
FIG. 5 is a cross-sectional view of the blender assembly according to the present invention.

Now referring to FIG. 5, the blender assembly comprises a gear housing 6 having two arms 7 extending therefrom which may be grasped by a user when sliding the assembly along the horizontal track 4. Mounted above the housing is a hollow receptacle 11 having a drive shaft 49 extending from the lower surface thereof. The drive shaft is received within the housing 6 and has a gear 8 mounted thereon that engages the track.

The track includes an upper arcuate channel 20 for engaging one or more upper track bearings 15 mounted within the housing and a lower arcuate channel 21 for engaging one or more lower track bearings 16 mounted within the housing to assure that the blender assembly smoothly slides relative to the track. Upper 13 and lower 14 bearings are also within the housing adjacent the shaft to ensure uninhibited rotation of the shaft within the housing. Both the gear and the track may also include a plurality of interengaging gear teeth to drive the shaft more efficiently. The blender assembly housing includes a removable portion 30. The removable portion allows precise adjustment if needed, and carries the lower track bearing on the top surface thereof for engaging the lower channel on the track. Accordingly, as the blender assembly is slid long the horizontal track, the gear's engagement with the track causes the gear, the shaft, and the receptacle to synchronously rotate.

A mixing container 10 is removably received within the receptacle 11. The mixing container has an open top end that is covered with a removable strainer 9. A glass ring 12 circumferentially surrounds the mixing container 10 proximal its open end which may be grasped by a user when pouring a drink or otherwise grasping the container. The mixing container also includes a plurality of ridges 40 on the exterior surface thereof so that the container frictionally engages the receptacle when the receptacle is rotating and which allows the container to be easily removed when the container is lifted upwardly.

To use the above described device, a user places the desired ingredients into the mixing container, grasps the handles and moves the housing horizontally along the track causing the gear to rotate as the housing traverses the track. The gear, shaft and receptacle thereby rotate in unison to mix a beverage received within the mixing container. Conventional beverage containers may be stored on any of the shelves or within the illuminable compartment if desired.

As is readily apparent from the above description, the present invention provides a bar having an associated beverage blender assembly that is convenient and easy to operate. The size, shape and materials of construction of the above described components may be varied to suit a particular application without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination bar and beverage mixing device comprising:

a base panel having front and rear surfaces;

a horizontal track mounted on the front surface of said base panel;

a gear housing slidably mounted on said track;

a drive shaft received within said housing and engaging said track;

a receptacle mounted on said drive shaft whereby sliding said gear housing horizontally in either direction along said track rotates said drive shaft and thus said receptacle.

2. The beverage storage according to claim 1 further comprising:

a mixing container removably received within said receptacle for receiving a beverage.

3. The beverage storage according to claim 2 wherein said track includes arcuate upper and lower surfaces.

4. The beverage storage according to claim 3 wherein said gear housing includes an upper bearing and a lower bearing received therein, said upper bearing engaging the upper arcuate surface of said track, said lower bearing engaging the arcuate lower surface of said track to assure that the gear housing slides smoothly relative to said track.

5. The beverage storage according to claim 4 wherein said gear housing further includes shaft bearings engaging said drive shaft to assure unhibited rotation thereof.

6. The beverage storage and mixing device according to claim 5 further comprising at least one mounting bracket on the rear surface of said base panel for attaching said base panel to a support structure.

7. The beverage storage and mixing device according to claim 6 further comprising a plurality of spacers mounted on the rear surface of the base panel for maintaining the base panel a predetermined distance from the support structure.

8. The beverage storage and mixing device according to claim 7 further comprising at least one horizontal shelf mounted on the front surface of the base panel on which beverage containers are stored.

9. The beverage storage and mixing device according to claim 8 wherein the front surface of said base panel further includes a recessed storage compartment for receiving and storing accessories.

10. The beverage storage and mixing device according to claim 9 wherein the recessed storage compartment includes a light therein for illuminating said storage compartment.

11. The beverage storage and mixing device according to claim 2 wherein said mixing container includes an open end having a strainer removably mounted thereover.

12. The beverage storage and mixing device according to claim 11 further comprising a handle extending from said gear housing which is grasped by user to slide the housing along said track.

13. The beverage storage and mixing device according to claim 12 wherein said mixing container includes an exterior surface with a plurality of ridges disposed thereon, said ridges frictionally engaging said receptacle when said container is received therein.

14. The beverage storage and mixing device according to claim 13 wherein said mixing container further includes a ring protruding from the exterior surface thereof, said ring proximate the open end to assist a user in grasping the container.

15. The beverage storage according to claim 1 wherein said shaft has a gear mounted thereon, said gear engaging said track.

* * * * *